US005599044A

United States Patent [19]

Lykens

[11] Patent Number: 5,599,044

[45] Date of Patent: Feb. 4, 1997

[54] TRANSPARENT PLASTIC PROTECTOR FOR WIRE BOUND NOTEBOOK

[76] Inventor: Thomas B. Lykens, 204 Winnebago Dr., Lake Winnebago, Mo. 64034

[21] Appl. No.: 555,141

[22] Filed: Nov. 8, 1995

[51] Int. Cl.[6] ..... B42D 3/04

[52] U.S. Cl. ..... 281/19.1; 281/51; 206/424

[58] Field of Search ..... 206/424; 281/29, 281/31, 19.1, 15.1, 4, 17, 51

[56] References Cited

U.S. PATENT DOCUMENTS

| | | | |
|---|---|---|---|
| 2,302,153 | 11/1942 | Spinner | 206/424 X |
| 2,580,141 | 12/1951 | Vidal | 206/424 X |
| 2,622,897 | 12/1952 | Zenick | 206/424 X |
| 2,728,450 | 12/1955 | Haire | 206/424 X |
| 3,809,311 | 5/1974 | Fohrman et al. | 206/424 X |
| 4,150,844 | 4/1979 | Yoshizawa | 281/19 R |
| 4,355,822 | 10/1982 | McHugh | 281/34 |
| 4,962,951 | 10/1990 | Mechesney | 283/114 |
| 5,178,414 | 1/1993 | Small et al. | 281/35 |

*Primary Examiner*—Willmon Fridie, Jr.
*Attorney, Agent, or Firm*—Joseph H. McGlynn

[57] ABSTRACT

A transparent protective casing for wire bound notebooks featuring a flared top opening. The flared shape of the top aperture affords enhanced protection for wire bindings and easy insertion and removal of items. The transparency of the invention allows for convenient viewing of the contents, and the dimensions may vary to accommodate a variety of wire bound products.

3 Claims, 1 Drawing Sheet

TRANSPARENT PLASTIC PROTECTOR FOR WIRE BOUND NOTEBOOK

BACKGROUND OF THE INVENTION

This invention relates in general to notebook protectors and specifically to a notebook protector comprising a transparent casing with a flared top aperture. The invention provides enhanced protection, easy access, and convenient usage for various types of wire bound notebooks.

DESCRIPTION OF THE PRIOR ART

In the prior art various types of protectors have been developed to prevent damage to books, magazines, notebooks, and other vulnerable paper products. For example, U.S. Pat. No. 4,355,822 discloses a cover designed to accommodate paperbacks, textbooks, and directories of varying thicknesses. U.S. Pat. No. 5,178,414 describes a protective magazine cover which features a convenient pressure sensitive adhesive bonding material, and which is also designed to accommodate materials of various sizes. However, notably lacking in the prior art protectors is an invention, like the present one, which is designed specifically to prevent damage to the paper and wire binding of pocket-type notebooks, and which provides for convenient insertion, removal, and usage of such notebooks in the work environment.

SUMMARY OF THE INVENTION

The notebook protector of the present invention is constructed from inexpensive, transparent plastic or some other similar, sturdy material. The invention comprises a one-piece rectangular casing with an inside protective cavity, into which the notebook is inserted. The top opening of the casing is flared into a greater width than the remainder of the casing. This provides a larger area of encasement for the wire binding of the notebook, allowing the user more easily to insert and remove the notebook from the protective cavity. The flaring of the top aperture also prevents a common problem encountered with wire bound notebooks, namely, flattening of the wire binding typically caused by workplace stresses and insertion of the notebook into ill-fitting containers. Moreover, since the invention is transparent, the user is able to view two pages of the notebook, through both the front and back, when it is inserted into the protector. This provides for quick, easy viewing of information contained in the notebook without having to remove the notebook from the protector.

It is an object of the present invention to provide an improved notebook protector.

It is an object of the present invention to provide an improved notebook protector that is inexpensive to construct.

It is an object of the present invention to provide an improved notebook protector which is transparent, to allow for viewing of the contents from both the front and back of the protector.

It is an object of the present invention to provide an improved notebook protector that features a flared top aperture designed to provide enhanced protection for wire bound notebooks, easier insertion and removal of such notebooks, and convenient usage.

These and other objects and advantages of the present invention will be fully apparent from the following description, when taken in connection with the annexed drawings.

DESCRIPTION OF THE PREFERRED EMBODIMENT

Figure 2:
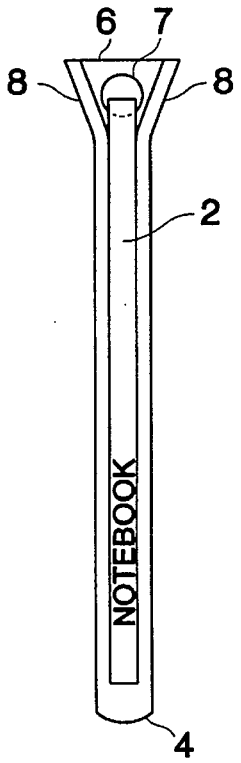
FIG. 2 is a side view of the invention, again with a notebook inserted.

Referring now to the drawings in greater detail, the invention 1 comprises a transparent rectangular casing having sides 3, a bottom 4 and a flared top 5, forming a hollow protective cavity into which a notebook 2 may be inserted. The top has an aperture 6 which is flared at 5. As seen in FIG. 2, the front and back of the aperture 6 are flared. This provides a greater thickness than the remainder of the casing, which makes it easier to insert and remove the notebook 2.

Plastic is the preferred material in the construction of the protector 1, however, any sturdy, waterproof, transparent material will suffice without departing from the scope of the invention. The transparency of the material is significant, however, because it is this quality which affords the user the ability to view the contents of the notebook from both the front and back without having to remove the item from the protector. This allows the user to see the front and back pages of the notebook without removing it from its protective casing. This is especially important if it is used on a work site where it is subject to damage from wind, rain, spills, dirt, grease, etc., and, thus make the pages difficult or impossible to read.

Figure 1:
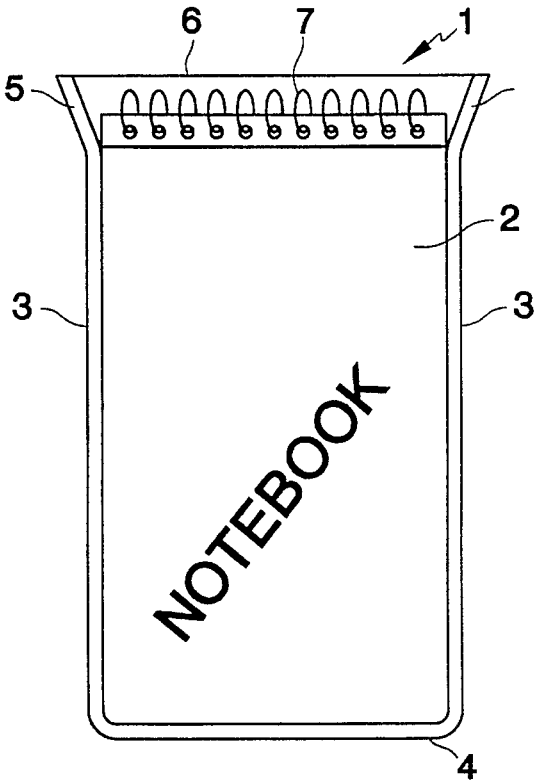
FIG. 1 is a front view of the invention with a spiral notebook inserted into the protective cavity.

Referring to the drawings, FIGS. 1 and 2 taken together illustrate the flared shape of the top opening 6 of the invention.

As illustrated in FIG. 2, the top of the casing also angles outward on the front and back sides 8, providing an enlarged space to accommodate the wire bindings 7 and thus avoiding smashed wire loops. Since the wire bindings of most notebooks, when viewed from the side, are wider than the thickness of the notebook itself, the extra front-to-back spacing of the protector at the top aperture avoids the familiar flattening of the wire loops.

The flared shape of the top opening 6, in addition to providing convenient removal and enhanced protection, is also designed to allow for easy insertion of the notebook. The funneled shape of the opening provides a larger space in which to push the bottom of the notebook when it is inserted, so that the end of the notebook slides in easily, without hanging up on the top of the casing.

The actual dimensions of the protector may vary in great degree without departing from the scope of the invention. Wire bound materials come in a variety of lengths, widths, and thicknesses, and the present invention is designed to accommodate the various spiral bound products already on the market, such as cookbooks, road atlases, steno notebooks, and project planners, as well as those yet to be produced. Whatever the size or shape of the notebook to be used, however, the protector will be designed to hold the item in a slightly less than snug fashion. Thus, the notebook will not be apt to fall out, nor will it be held so tightly as to impede insertion and removal.

Figure 3:
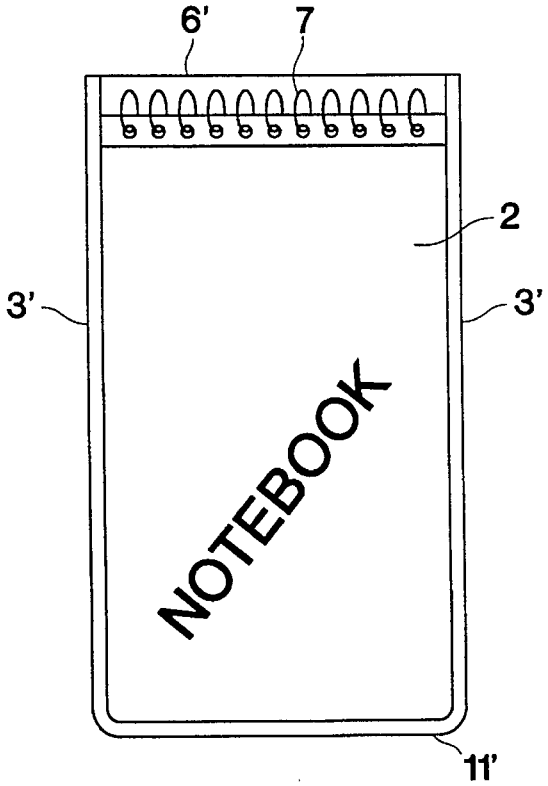
FIG. 3 is a front view of a second embodiment of the invention with a spiral notebook inserted into the protective cavity.
Figure 4:
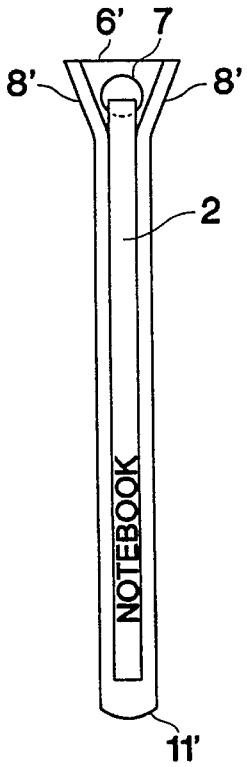
FIG. 4 is a side view of the second embodiment of the invention with a notebook inserted.

The embodiment of the notebook protector shown in FIGS. 3 and 4 is the same as the embodiment already described except the flared end 5 of the top of the protector has been eliminated. The top aperture 6' angles only on the front and back sides 8', as shown in FIG. 4. The sides 3' and bottom 4' are the same as sides 3 and bottom 4 in the FIG. 1 embodiment.

Although the spiral notebook protector and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A protective casing for a notebook comprising:

an enclosure comprising two sides, two ends, a closed bottom and an open top, said sides having a first lateral dimension, said ends having a second lateral dimension which is smaller than said first lateral dimension, said open top having a third lateral dimension immediately adjacent said sides which is approximately the same as said first lateral dimension, and said open top having a fourth lateral dimension immediately adjacent said ends which is approximately the same as said second lateral dimension, and said open top having a fifth lateral dimension removed from said ends which is larger than said fourth lateral dimension, whereby a notebook may easily be inserted and removed from said protective casing.

2. The protective casing as claimed in claim 1, wherein said enclosure is made from transparent plastic.

3. A protective casing for a notebook as claimed in claim 1, comprising: said open top having a sixth lateral dimension removed from said sides which is larger than said third lateral dimension.

* * * * *